US007025221B2

(12) United States Patent
Kim

(10) Patent No.: US 7,025,221 B2
(45) Date of Patent: Apr. 11, 2006

(54) STORAGE CONTAINER

(75) Inventor: Jong Gun Kim, Hwasung (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 76 days.

(21) Appl. No.: 10/649,799

(22) Filed: Aug. 28, 2003

(65) Prior Publication Data

US 2004/0118850 A1 Jun. 24, 2004

(30) Foreign Application Priority Data

Dec. 23, 2002 (KR) ..... 10-2002-0082713
Mar. 3, 2003 (KR) ..... 10-2003-0013181

(51) Int. Cl.
*B65D 95/16* (2006.01)

(52) U.S. Cl. ..... 220/324; 220/4.33

(58) Field of Classification Search ..... 220/234, 220/8, 560.08, 573.1, 4.33, 287, 780, 315; 190/103–105; 292/81; 215/305–306
See application file for complete search history.

(56) References Cited

U.S. PATENT DOCUMENTS 281,268 A * 7/1883 Haskell ..... 190/105
1,015,455 A * 1/1912 Neesham ..... 220/8
1,946,149 A * 2/1934 Churchill ..... 205/201
2,574,384 A * 11/1951 George ..... 229/125.23
3,471,054 A * 10/1969 Ostrowsky et al. ..... 220/318
4,034,884 A * 7/1977 White ..... 220/8
5,125,697 A * 6/1992 Kahl et al. ..... 292/204
5,385,257 A * 1/1995 Hung ..... 220/324
5,715,962 A * 2/1998 McDonnell ..... 220/4.03
6,824,004 B1 * 11/2004 Wooderson ..... 220/318

FOREIGN PATENT DOCUMENTS

JP 10-236496 9/1998
JP 2003-81274 3/2003

* cited by examiner

*Primary Examiner*—Lien M. Ngo
(74) *Attorney, Agent, or Firm*—Staas & Halsey LLP

(57) ABSTRACT

A storage container designed such that a locking unit to removably lock a cover to a body has a plurality of locking positions, thus allowing a storage space for storing items to be variable. The locking unit includes a locking member and a rotary member. The locking member is provided at a side of the cover. The rotary member is rotatably mounted at a side of the body, and has a plurality of locking holes. The locking holes are arranged on the rotary member along a vertical direction. When the locking member is inserted into a lowermost hinge hole, the storage space has a minimum volume. When the locking member is inserted into an uppermost hinge hole, the storage space has a maximum volume. When the locking member is inserted into a middle hinge hole, the storage space has a middle volume.

7 Claims, 7 Drawing Sheets

STORAGE CONTAINER

CROSS-REFERENCE TO RELATED APPLICATIONS

This application claims the benefit of Korean Patent Application No. 2002-82713 filed on Dec. 23, 2002 and Korean Patent Application No. 2003-13181 filed on Mar. 3, 2003 in the Korean Intellectual Property Office, the disclosures of which are incorporated herein by reference.

BACKGROUND OF THE INVENTION

1. Field of the Invention

The present invention relates, in general, to storage containers to store items such as cooking utensils and foods, and, more particularly, to a storage container, which is designed such that a locking unit to removably lock a cover to a body has a multistage structure, thus allowing a storage space to store the items to be variable.

2. Description of the Related Art

Generally, a cooking device, such as a microwave oven, has auxiliary cooking devices including a grilling unit which is used to grill foods, such as meat and fish, a skewer, and a toasting kit which is used to toast bread. In order to easily and conveniently store and use the auxiliary cooking devices, the auxiliary cooking devices are stored in a storage container.

The storage container to store items such as the auxiliary cooking devices and foods, includes a body, a cover, and a locking unit. The body defines a storage space to store the items therein. The cover covers a top of the body so as to prevent the storage space of the body from being exposed to the outside. The locking unit functions to lock or unlock the cover to or from the body.

When the cover is locked to the body by the locking unit, the items are stably stored in the body without being undesirably removed from the body. Meanwhile, when the cover is unlocked from the body by the locking unit, a user may take out the stored items from the body or put new items into the body.

However, in conventional locking units, the cover is locked to the body at only a fixed position, so the storage container has a fixed interior volume when the cover is locked to the body by the locking unit Thus, the conventional storage unit has a problem that an interior volume thereof is not variable according to size or amount of items to be stored in the storage unit. That is, although the size or amount of items to be stored is small and the items occupy a small space in the storage container, the storage container has a fixed volume, so it is impossible to reduce the size of the storage container. Meanwhile, when the size or the amount of items to be stored is large, it is impossible to store the items in a single storage container, so several storage containers are required.

SUMMARY OF THE INVENTION

Accordingly, it is an aspect of the present invention to provide a storage container including a locking unit having a plurality of locking positions, to removably lock a cover to a body, thus allowing variation in the size of a storage space to store items.

Additional aspects and advantages of the invention will be set forth in part in the description which follows and, in part, will be obvious from the description, or may be learned by practice of the invention.

The foregoing and/or other aspects of the present invention are achieved by a storage container including a body, a cover locked to the body, and a plurality of locking units to removably lock the cover to the body. Each of the locking units has a plurality of locking positions so that the cover is locked to the body at a plurality of locked positions, thus allowing a storage space defined by the body and the cover to be variable according to the locked positions.

Each of the locking units includes a locking member provided at a side of the cover, and a rotary member rotatably mounted at a side of the body and having a plurality of locking holes so that the locking member is inserted into one of the locking holes, thus locking the rotary member to the locking member.

A first hinge hole is included at each of two lower extensions formed at both corners of a lower end of the rotary member, and a bracket having a second hinge hole corresponding to the first hinge hole is included at a predetermined portion of the body, so the bracket is placed between the two lower extensions of the rotary member and a hinge shaft is fitted into the first and second hinge holes so that the rotary member is rotatably hinged to the body.

The locking holes are arranged on the rotary member along a vertical direction so the storage space defined by the cover and the body has a minimum volume when the locking member is inserted into a lowermost hinge hole, and the storage space has a maximum volume when the locking member is inserted into an uppermost hinge hole, and the storage space has a middle volume when the locking member is inserted into a middle hinge hole.

In an aspect of the invention, the rotary member is made of an elastic material so that the locking member is elastically fitted into one of the locking holes.

A first handle is included at a top surface of the cover and a second handle is included at an upper end of the rotary member to horizontally and outwardly extend from the upper end of the rotary member, thus allowing the storage container to be conveniently carried using the first or second handle according to a weight of an item which is stored in the storage container.

Further, according to another embodiment of the present invention, a hinge hole is included at each of two lower extensions formed at both corners of a lower end of the rotary member, and a bracket is included at a predetermined portion of the body and is provided at both side ends thereof with hinge shafts corresponding to the hinge holes, so the bracket is placed between the two lower extensions of the rotary member and the hinge shafts are fitted into the hinge holes so that the rotary member is rotatably hinged to the body.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
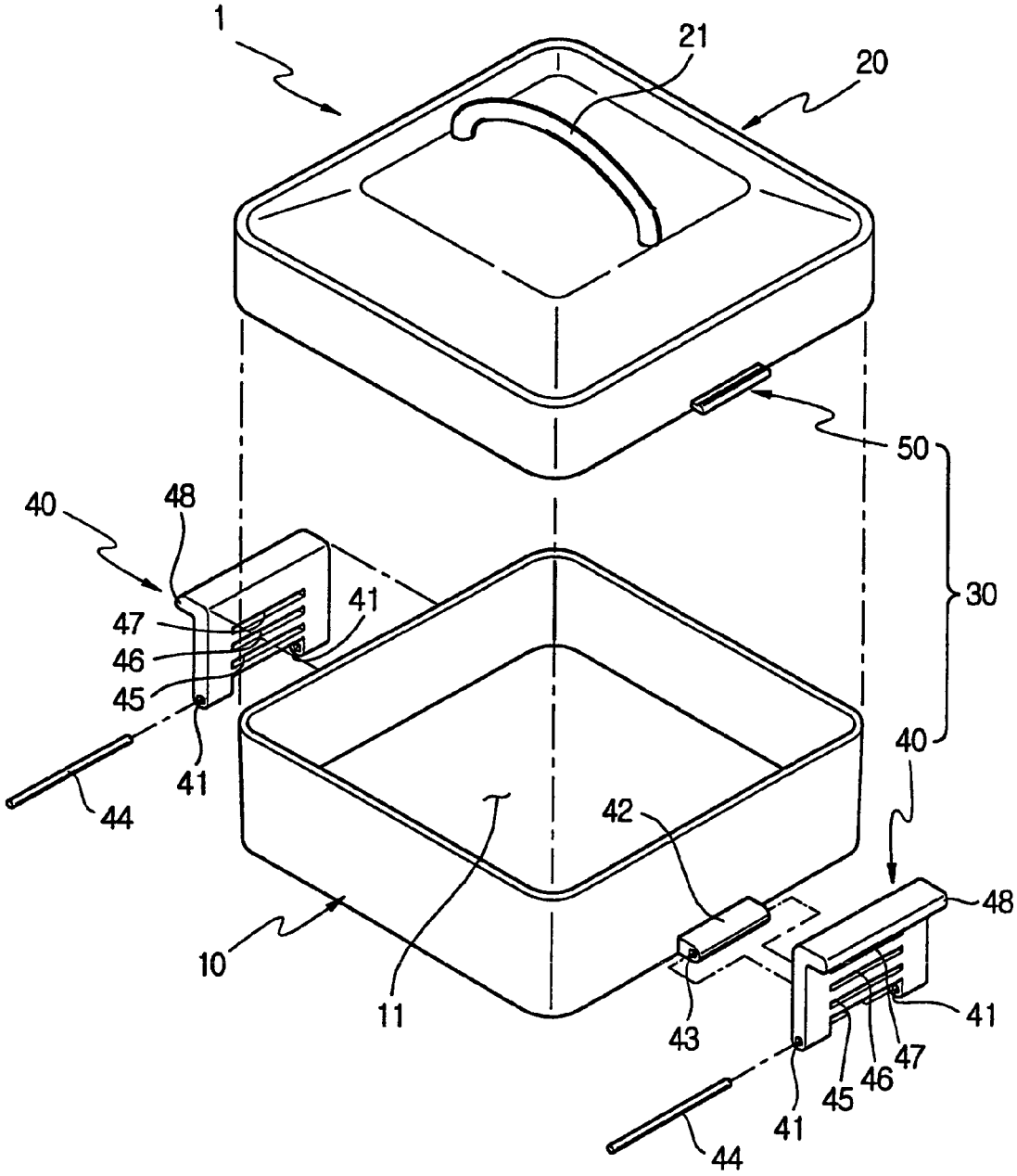
FIG. 1 is an exploded perspective view of a storage container according to an embodiment of the present invention with a cover being removed from a body.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
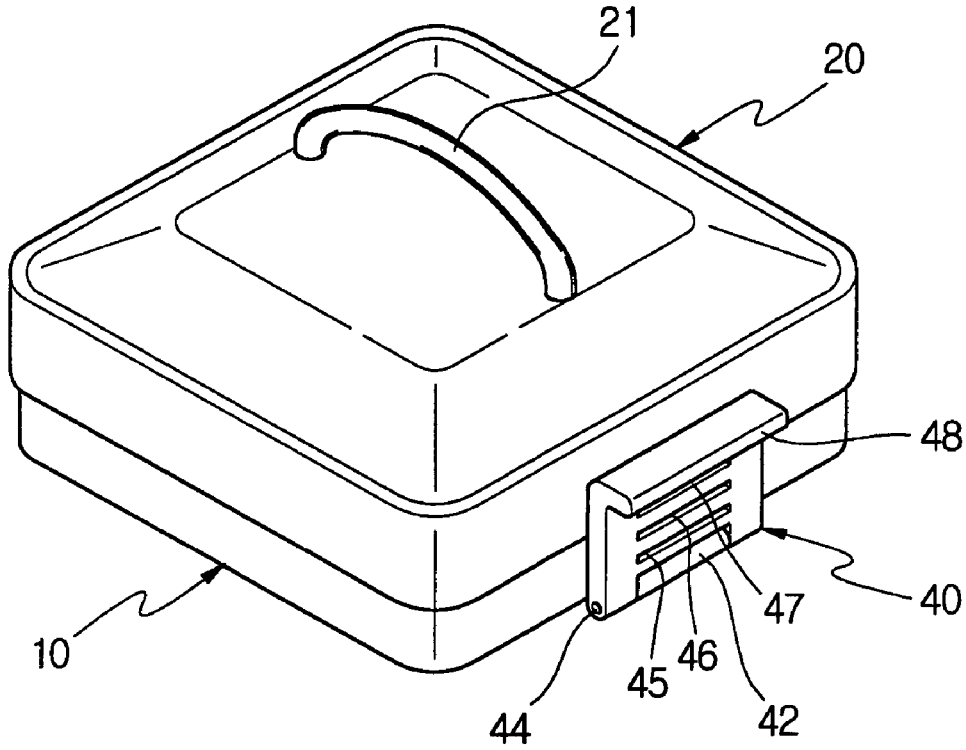
FIG. 2 is a perspective view of the storage container according to the embodiment of FIG. 1 with the cover being locked to the body.

FIG. 1 is an exploded perspective view of a storage container 1 according to an embodiment of the present invention, with a cover 20 being removed from a body 10. FIG. 2 is a perspective view of the storage container according to FIG. 1 with the cover being locked to the body.

As illustrated in FIG. 1, the storage container according to this embodiment includes a body 10. The body 10 has a box shape which is opened at its top. A cover 20 covers the top of the body 10 to define a storage space 11 to store items. The storage container also has two locking units 30 so that the cover 20 can be locked to the body 10 or removed from the body 10. A first handle 21 is included at a top surface of the cover 20, thus allowing a user to carry the storage container using the first handle 21 when the cover 20 is locked to the body 10 by the locking units 30. When an item stored in the storage space 11 is light in weight, a user carries the body 10 using the first handle 21. The locking units 30 are provided at both sides of the body 10 and the cover 20.

Since the two locking units 30 have the same construction, only one locking unit 30 which is provided at a side of the body 10 and the cover 20 will be described herein.

The locking unit 30 includes a rotary member 40 and a locking member 50. The rotary member 40 is mounted at a side of the body 10 to be rotated upward and downward. The locking member 50 is provided at a side of the cover 20 to correspond to the rotary member 40.

The locking member 50 outwardly and horizontally extends from a lower end of the cover 20. The rotary member 40 is manufactured separately from the body 10, and is hinged to the body 10.

A first hinge hole 41 is included at each of two lower extensions formed at both corners of a lower end of the rotary member 40. A bracket 42 is provided at a predetermined portion of the body 10 to be outwardly projected from the body 10. A second hinge hole 43 is longitudinally bored through the bracket 42.

Thus, the bracket 42 is placed between the two lower extensions each having the first hinge hole 41 in such a way that the first hinges holes 41 of the rotary member 40 and the second hinge hole 43 of the bracket 42 are aligned with each other. Next, a hinge shaft 44 is fitted into the aligned first and second hinge holes 41 and 43 so that the rotary member 40 is mounted to the body 10 to be upwardly and downwardly rotated around the bracket 42 and the hinge shaft 44.

The hinge shaft 44 is loosely fitted into the first and second hinge holes 41 and 43 so that the rotary member 40 is smoothly rotatable around the hinge shaft 44. In such a case, the rotary member 40 and the bracket 42 prevent an unexpected removal of the hinge shaft 44 from the first and second hinge holes 41 and 43 when the hinge shaft 44 is fitted into the first and second hinge holes 41 and 43, so as to hinge the rotary member 40 to the bracket 42.

First, second, and third locking holes 45, 46, and 47 are arranged on the rotary member 40 along a vertical direction so that the locking member 50, provided at the cover 20, is inserted into one of the locking holes 45, 46, and 47. According to this embodiment, three locking holes are formed on the rotary member 40. But, three or more locking holes may be formed on the rotary member 40 without being limited to the embodiment, thus allowing a volume of the storage space to be more varied.

In order to prevent the locking member 50 from being unexpectedly removed from the locking hole 45, 46, or 47, the rotary member 40 is made of an elastic material. Thus, when the locking member 50 is inserted into one of the locking holes 45, 46, and 47, the locking hole 45, 46, 47 are forced to expand to receive the locking member 50, so the locking member 50 is stably locked to the rotary member 40. Meanwhile, when a user desires to remove the locking member 50 from the locking hole 45, 46, 47, the user has only to apply a predetermined magnitude of force to the rotary member 40 so that the rotary member 40 is downwardly rotated.

Figure 3:
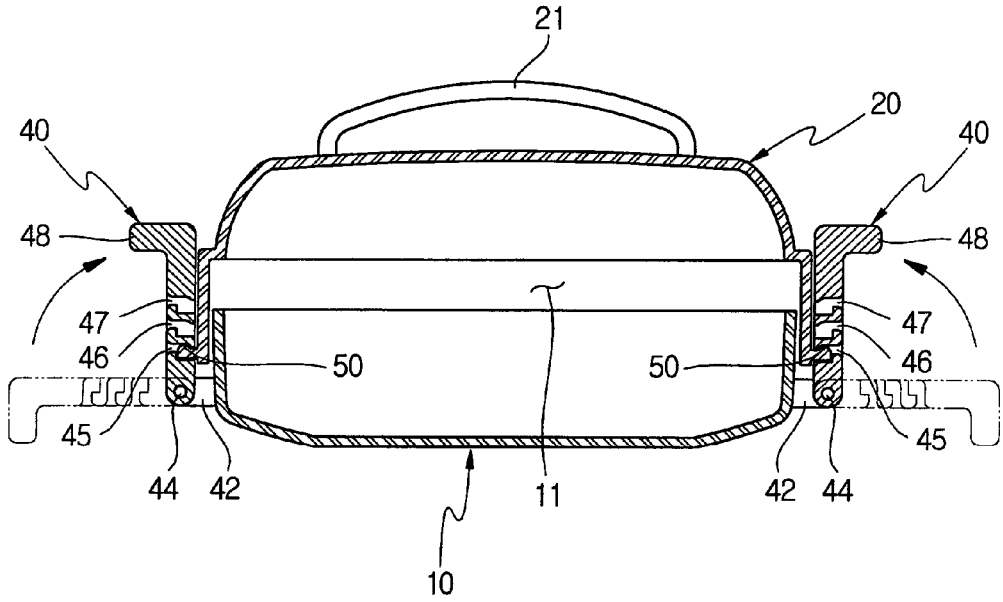
FIG. 3 is a sectional view of the storage container according to the embodiment of FIG. 1 when the cover is locked to the body by a locking unit so that the storage container has a minimum volume.

Locking member 50 includes a locking projection projected upwards along an end of the locking member 50 while each of the locking holes 45, 46, and 47 includes along an upper inside edge thereof with a locking projection which is downwardly projected, thus allowing the locking member 50 to be hooked to the locking hole 45, 46, 47 (see, FIG. 3).

A second handle 48 is included at an upper end of the rotary member 40 to horizontally and outwardly extend from the upper end of the rotary member 40. Thus, when a heavy item is stored in the storage space 11 of the body 10, a user may grasp the two second handles 48 with both hands to carry the storage container.

In the locking unit 30 constructed in this way, the rotary member 40 is hinged to a side of the body 10, and the locking member 50 is inserted into one of the first to third locking holes 45, 46, 47 so that the cover 20 is locked to the body 10, thus allowing an item to be stored in the storage space 11 defined by the cover 20 and the body 10, as illustrated in FIG. 2.

The operation of varying a volume of the storage space 11 of the storage container according to the present invention will be described in the following, with reference to FIGS. 3 through 5.

FIG. 3 is a sectional view of the storage container according to FIG. 1 when the cover 20 is locked to the body 10 by a locking unit 30 so that the storage container has a minimum volume. FIG. 4 is a sectional view of the storage container according to FIG. 1 when the cover 20 is locked to the body 10 by the locking unit 30 so that the storage container has a middle volume. FIG. 5 is a sectional view of the storage container according to FIG. 1 when the cover 20 is locked to the body 10 by the locking unit 30 so that the storage container has a maximum volume.

First, the rotary member 40 of the locking unit 30 is upwardly rotated from a state shown by the dotted line of FIG. 3. Next, the locking member 50 of the locking unit 30 is inserted into the lowermost first locking hole 45 of the locking holes 45, 46, and 47 which are arranged on the rotary member 40 along the vertical direction. At this time, the cover 20 is locked to the body 10 so that the storage space 11 has a minimum volume. Thus, when items to be stored in the storage container are small in size and number, it is possible to reduce a volume of the storage container to a minimum.

When the upper end of the rotary member 40 is downwardly pulled in such a state, the rotary member 40 is downwardly rotated so that the locking member 50 is removed from the first locking hole 45. At this time, the cover 20 is unlocked from the body 10, thus allowing a user to remove the stored item from the storage container.

Figure 4:
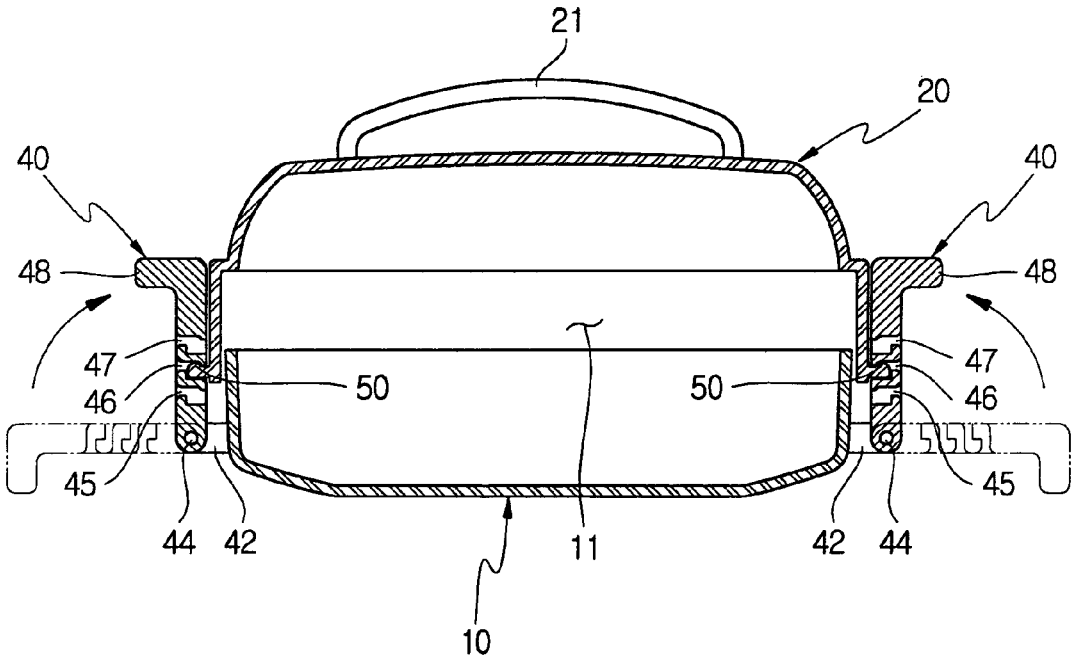
FIG. 4 is a sectional view of the storage container according to the embodiment of FIG. 1 when the cover is locked to the body by the locking unit so that the storage container has a middle volume.
Figure 5:
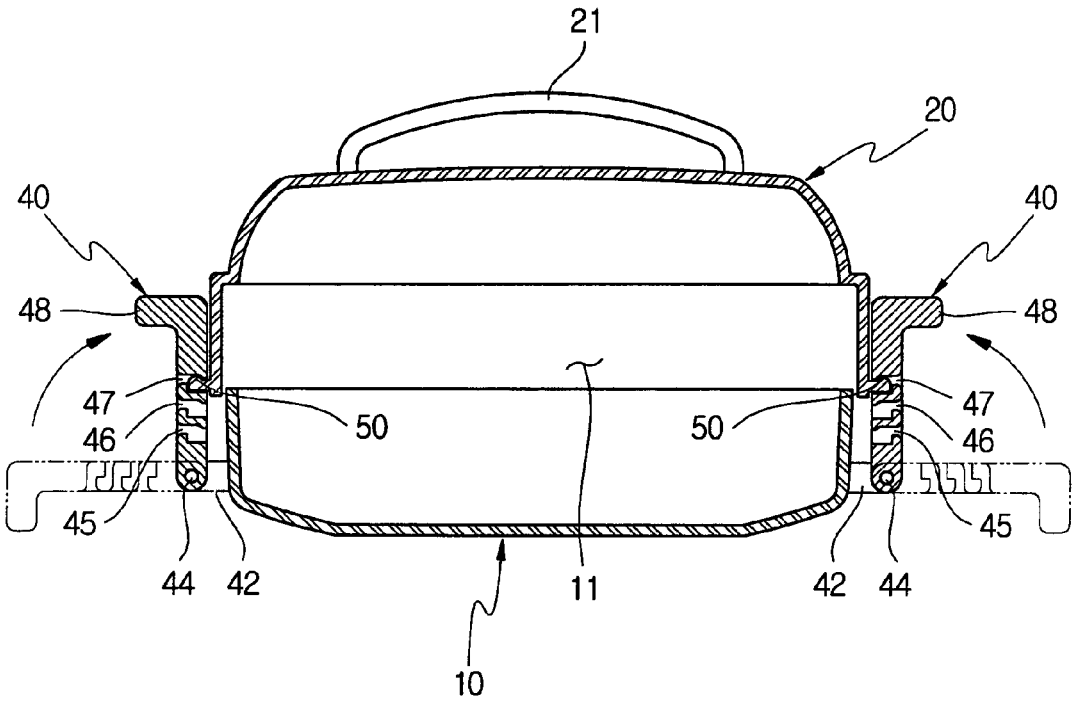
FIG. 5 is a sectional view of the storage container according to the embodiment of FIG. 1 when the cover is locked to the body by the locking unit so that the storage container has a maximum volume.

Meanwhile, when items to be stored are relatively modest in size and number, the rotary member 40 of the locking unit 30 is upwardly rotated from a state shown by the dotted line of FIG. 4, and the locking member 50 of the locking unit 30 is inserted into the second locking hole 46. In this case, the cover 20 is locked to the body 10 so that the storage space 11 has a middle volume, thus allowing the items which are of a medium size and number to be stored in the storage container.

In such a state, when one desires to further put other items into the storage container, a volume of the storage space 11 of the storage container must be increased. In this case, as illustrated in FIG. 5, the locking member 50 of the cover 20 is inserted into the third locking hole 47 which is formed at an uppermost position of the rotary member 40. In this case, the cover 20 is locked to the body 10 so that the storage space 11 has a maximum volume, thus allowing items which are large in size and number to be stored in the storage container.

Figure 6:
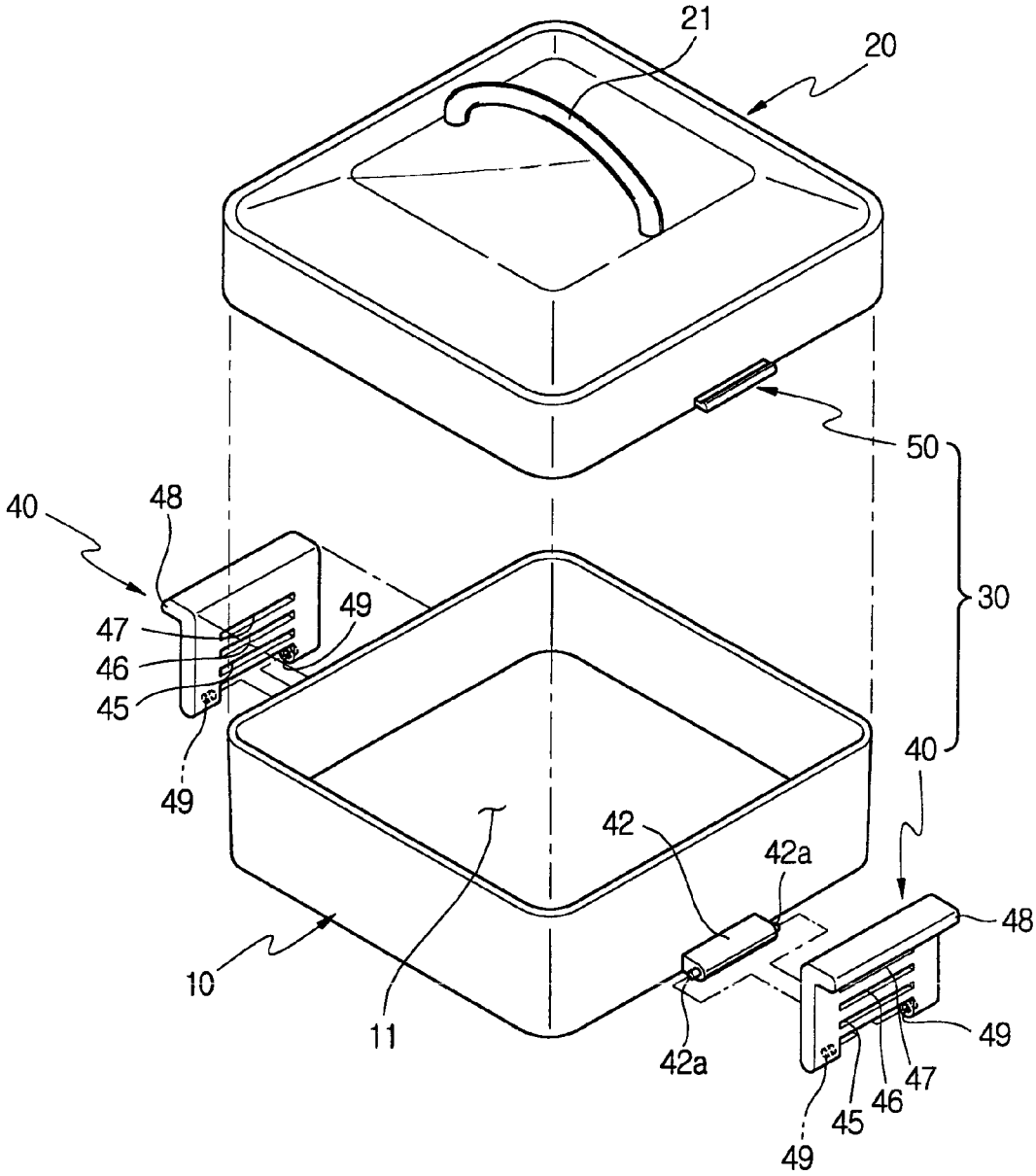
FIG. 6 is an exploded perspective view of a storage container according to another embodiment of the present invention.
Figure 7:
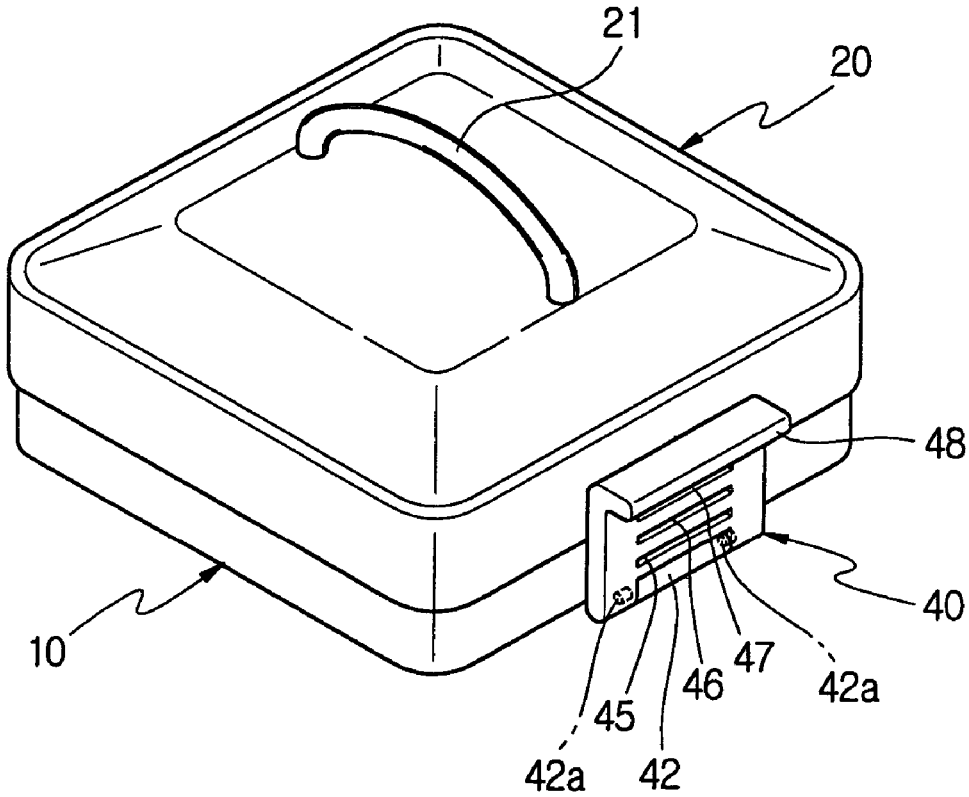
FIG. 7 is a perspective view of the storage container illustrated in FIG. 6 with a cover being locked to a body.

FIGS. 6 and 7 are an exploded perspective view and a perspective view of a storage container according to another embodiment of the present invention, respectively. As illustrated in FIGS. 6 and 7, hinge shafts 42*a* are longitudinally projected from both side ends of a bracket 42. In this case, the hinge shafts 42*a* are integrated with the bracket 42 to form a single structure. A hinge hole 49 is included at each of two lower extensions formed at both corners of a lower end of a rotary member 40 to correspond to the hinge shaft 42*a*.

Thus, in order to insert the hinge shafts 42*a* into the corresponding hinge holes 49, the two lower extensions of the rotary member 40 are forced outwards to get wider. In this way, the rotary member 40 is hinged to the bracket 42 to be rotated upward and downward.

Since the storage container illustrated in FIGS. 6 and 7 has the same construction as the storage container illustrated in FIGS. 1 to 5, except for the bracket 42 and the rotary member 40, further description of the construction and operation of the storage container illustrated in FIGS. 6 and 7 is not necessary.

As apparent from the above description, the present invention includes a storage container, in which a cover is locked to a body in such a way as to vary the size of a storage space defined by the cover and the body, thus allowing a volume of the storage space to be varied according to the size and number of items to be stored, therefore being convenient to use.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A storage container, comprising:

a body;

a cover; and a plurality of locking units to removably lock the cover to the body, each of the locking units having a plurality of locking positions so that the cover is locked to the body at a plurality of locked positions, thus allowing a storage space defined by the body and the cover to be variable according to the locked positions, wherein each of the locking units comprises:

a locking member provided at a side of the cover, and a rotary member rotatably mounted at a side of the body and having a plurality of locking holes so that the locking member is inserted into one of the locking holes, thus locking the rotary member to the locking member.

2. The storage container according to claim 1, further comprising:

a first hinge hole at each of two lower extensions formed at both corners of a lower end of the rotary member;

a bracket having a second hinge hole corresponding to the first hinge hole at a predetermined portion of the body so the bracket is placed between the two lower extensions of the rotary member; and a hinge shaft fitted into the first and second hinge holes so that the rotary member is rotatably hinged to the body.

3. The storage container according to claim 1, wherein the locking holes are arranged on the rotary member along a vertical direction so the storage space defined by the cover and the body has a minimum volume when the locking member is inserted into a lowermost hinge hole, the storage space has a maximum volume when the locking member is inserted into an uppermost hinge hole, and the storage space has a middle volume when the locking member is inserted into a middle hinge hole.

4. The storage container according to claim 1, wherein the rotary member is made of an elastic material so that the locking member is elastically fitted into one of the locking holes.

5. The storage container according to claim 1, wherein a first handle is provided at a top surface of the cover.

6. The storage container according to claim 1, further comprising a second handle at an upper end of the rotary member to horizontally and outwardly extend from the upper end of the rotary member.

7. The storage container according to claim 1, further comprising:

a hinge hole at each of two lower extensions formed at both corners of a lower end of the rotary member; and a bracket at a predetermined portion of the body and provided at both side ends thereof with hinge shafts corresponding to the hinge holes so the bracket is placed between the two lower extensions of the rotary member and the hinge shafts are fitted into the hinge holes so that the rotary member is rotatably hinged to the body.

* * * * *